US009874059B2

(12) United States Patent
Grimsbo et al.

(10) Patent No.: US 9,874,059 B2
(45) Date of Patent: Jan. 23, 2018

(54) METHOD OF CENTRALISING TUBING IN A WELLBORE

(71) Applicant: STATOIL PETROLEUM AS, Stavanger (NO)

(72) Inventors: Gjermund Grimsbo, Trondheim (NO); Pål Viggo Hemmingsen, Trondheim (NO); Rune Godøy, Sandnes (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/023,296

(22) PCT Filed: Sep. 18, 2014

(86) PCT No.: PCT/EP2014/069874
§ 371 (c)(1),
(2) Date: Mar. 18, 2016

(87) PCT Pub. No.: WO2015/040103
PCT Pub. Date: Mar. 26, 2015

(65) Prior Publication Data

US 2016/0237763 A1 Aug. 18, 2016

(30) Foreign Application Priority Data

Sep. 20, 2013 (GB) ..... 1316710.1

(51) Int. Cl.
*E21B 17/10* (2006.01)
*E21B 43/10* (2006.01)
*E21B 33/13* (2006.01)

(52) U.S. Cl.
CPC ..... *E21B 17/1014* (2013.01); *E21B 17/10* (2013.01); *E21B 17/1021* (2013.01); *E21B 17/1078* (2013.01); *E21B 33/13* (2013.01); *E21B 43/103* (2013.01)

(58) Field of Classification Search
CPC ... E21B 17/10; E21B 17/1014; E21B 17/1078
See application file for complete search history.

(56) References Cited

U.S. PATENT DOCUMENTS 5,785,125 A 7/1998 Royer
5,979,550 A 11/1999 Tessier
6,374,918 B2 * 4/2002 Roberts ..... E21B 7/061 166/191
2003/0226668 A1 12/2003 Zimmerman et al.
(Continued)

FOREIGN PATENT DOCUMENTS

GB 2 401 127 A 11/2004
GB 2 424 603 A 8/2007
(Continued)

*Primary Examiner* — Catherine Loikith
(74) *Attorney, Agent, or Firm* — Birch, Stewart, Kolasch & Birch, LLP

(57) ABSTRACT

A method of centralizing a tubing in a wellbore includes providing one or more expandable elements between the tubing and a surrounding casing located in a wellbore and expanding the expandable elements against the casing so as to cause the tubing to become centered within the casing. Alternatively, one or more portions of a tubing are expanded against a surrounding casing located in a wellbore so as to cause the tubing to become centered within the casing.

18 Claims, 2 Drawing Sheets

(56) References Cited

U.S. PATENT DOCUMENTS

| | | | |
|---|---|---|---|
| 2005/0150654 | A1 | 7/2005 | Kirk et al. |
| 2005/0224227 | A1 | 10/2005 | Hendrie |
| 2007/0007015 | A1 | 1/2007 | Thornton |
| 2012/0279725 | A1 | 11/2012 | O'Connor |

FOREIGN PATENT DOCUMENTS

| | | | |
|---|---|---|---|
| GB | 2 447 545 | A | 9/2008 |
| GB | 2 458 527 | A | 9/2009 |
| GB | 2488152 | A | 8/2012 |
| WO | WO 00/37772 | A1 | 6/2000 |
| WO | WO 02/02904 | A1 | 1/2002 |
| WO | WO 03/006790 | A1 | 1/2003 |
| WO | WO 2004/040098 | A1 | 5/2004 |
| WO | WO 2009/071874 | A2 | 6/2009 |

* cited by examiner

METHOD OF CENTRALISING TUBING IN A WELLBORE

FIELD OF THE INVENTION

The present invention relates to a method of centralising tubing in a wellbore. In particular embodiments, the method comprises centralising tubing in a wellbore prior to installing a permanent fluid-tight barrier around the tubing for well abandonment.

BACKGROUND TO THE INVENTION

Traditional plug and abandonment operations require that the entire production tubing and associated cabling is pulled from the wellbore prior to installation of a cement plug.

However, the removal of the tubing is a costly and time-consuming exercise as it requires a drill rig on site. There are also associated safety risks.

SUMMARY OF THE INVENTION

The Applicants propose an alternative plug and abandonment technique in which the tubing is left in the well and a plug (usually of cement) is formed around the tubing to completely seal the well.

Rotation and centralisation are two of the most important parameters for a successful cement placement. However, production tubing is not currently centralised within the wellbore and instead tends to lie along the inner casing wall (with metal to metal contact), particularly in sloped portions of a wellbore which may be angled at a gradient of 60-80%. This configuration will significantly increase the risk for a poor and incomplete cement job resulting in an unsuccessful seal. There will also be a risk of damaging the casing when cutting the tubing to pump sealant into the annulus if the tubing is lying against the casing (e.g. due to gravity). Accordingly, the integrity of the well may be compromised.

There is therefore a need for a method of centralising tubing in a wellbore.

In accordance with a first aspect of the present invention there is provided a method of centralising tubing in a wellbore comprising:

- providing one or more expandable elements between a tubing and a surrounding casing located in a wellbore and expanding said expandable elements against the casing so as to cause the tubing to centre within the casing; or
- expanding one or more portions of a tubing against a surrounding casing located in a wellbore so as to cause the tubing to centre within the casing.

The method may be carried out on tubing that has been pre-installed in the wellbore. For example, the step of providing the one or more expandable elements may be performed in an intervention.

Embodiments of the invention therefore provide a method which can be used to effectively centralise production tubing within a wellbore. It should be noted that when a well is completed, there is currently no method for centralising the tubing without recompleting the well. An advantage of the present method is that it can be used in a retrofit (intervention) operation, preferably on wireline, to centralise existing tubing already installed down-hole.

It should be noted that the material and/or environment of the tubing may dictate which centralising technique is best. For example, providing one or more expandable elements may be preferred for a more controlled expansion but if penetrating the tubing is required to insert the expandable elements this should only be carried out if penetration of the tubing is considered safe (e.g. if the tubing is not lying too close to the casing). On the other hand, expanding portions of the tubing itself may be more time-efficient if the tubing is of a suitable material for expansion and the tubing conditions are known. The material quality of the tubing and casings may vary depending on the expected environment. Martensitic stainless steel, e.g. comprising 13% chromium, is commonly used for production tubing and casings that are exposed to hydrocarbons, while super duplex steel, e.g. comprising 25% chromium, is often used in more corrosive environments. Water injectors and casings are normally run with low alloy steels.

Even if production tubing were to be provided with centralisers on installation into the casing, there is always a risk that such centralisers could move or be damaged while the tubing is being run in hole so a retrofit centralising method would still be advantageous to ensure that the tubing is appropriately centred prior to a plug and abandonment operation. More specifically, a retrofit centralisation method according to the present invention reduces the risk of damaging the casing when penetrating the tubing for a cleanout operation and/or sealant placement.

The method may comprise forming one or more holes in the tubing for access to the annulus between the tubing and the casing. The holes may be provided for one or more of the following reasons: i) placing of the expandable elements between the tubing and the casing; ii) performing a clean-out operation in the annulus; iii) injecting a sealant into the annulus.

In the case where one or more portions of the tubing are expanded, there may be no need to provide holes in the tubing for centralisation. However, holes may still be required for injection of a sealant to plug the well.

The step of forming one or more holes in the tubing may comprise cutting, drilling, slicing, punching or perforating the tubing. The one or more holes may be formed by, for example, a mechanical, abrasive, chemical, thermal or explosive technique. It will be understood that, the step of forming one or more holes may comprise a radial depth control to ensure that the holes are only provided in the tubing and do not extend into the casing if the tubing is lying on or near to the casing.

The method may further comprise forming a fluid-tight seal between the tubing and the casing. This step may comprise injecting a sealant material through one or more holes in the tubing, into an annulus between the tubing and the casing. The seal may form a permanent barrier for well abandonment.

It will be understood that embodiments of the invention may be employed in plug and abandonment techniques which do not require the entire tubing to be pulled from the wellbore and which can be carried out using wireline-deployed apparatus. The centralisation of the tubing within the casing will, in general, ease all operations related to placing sealant material in the annulus. Furthermore, the cutting of tubing can be performed in a safer manner with reduced risk of damaging the surrounding casing.

The expandable elements may be mechanically, electrically, magnetically, chemically, hydraulically or pneumatically activated. Alternatively, the expandable elements may be activated using explosives. In certain embodiments, the expandable elements may comprise a spring, a jack, a piston or an expandable material. The expandable elements may be operated substantially simultaneously or in a pre-determined sequence.

In some embodiments, one or more expandable elements may be re-set and/or re-used in order to centralise the tubing. In which case, one or more supporting elements may be provided to maintain the tubing in a desired position after the one or more expandable elements have been expanded. This may allow an expandable element to be re-positioned (radially or axially) before being re-expanded to aid centralisation of another part of the tubing.

In some embodiments, the expandable elements may be provided on the tubing or casing prior to installation of the tubing in the casing. The expandable elements may initially be provided in a compact configuration. Accordingly, the method may comprise activating the expandable elements when it is desired to centralise the tubing within the casing. The expandable elements may be provided between the tubing and an intermediate tubular such that on activation, the intermediate tubular is expanded outwardly against the casing.

The portions of the tubing (or intermediate tubular) which are expanded may be radial portions so as to leave a fluid flow path through the annulus between the tubing and the casing.

The portions of the tubing (or intermediate tubular) may be expanded mechanically, electrically, magnetically, chemically, hydraulically, pneumatically or by using explosives. It may be advantageous for the portions of the tubing to be expanded substantially simultaneously.

The expandable elements may be provided between the tubing and casing and/or activated down-hole using wireline, coiled tubing or pipe.

Although two expandable elements or expanded portions may be sufficient for centralising the tubing if the orientation of the elements within the wellbore is known, it is most likely that the orientation will not be known and therefore at least three expandable elements or expanded portions are likely to be required.

The expandable elements or expanded portions may be radially positioned around the tubing, with equal spacing there-between. The distance between each expandable element (or expanded portion) may be determined in order to minimise local stresses. This could be achieved by providing a predetermined number of expandable elements (or expanded portions) per unit length of tubing.

The relative positions (phasing), shapes, angles, and radial and axial length of the expandable elements or expanded portions is not limited and may be optimised on a case by case basis (e.g. to suit the nature of the materials involved in addition to the well profile and well conditions).

The method may comprise centralising the tubing at multiple locations along the wellbore. The number and separation of each centralised section of the tubing will be dependent on the nature of the materials involved in addition to the well profile and well conditions.

Conveniently, each step in the method may be performed using wireline and the method may be carried out whether or not control cables are present in the location for the well seal.

According to a second aspect of the invention, there is provided an apparatus for centralising tubing in a wellbore, comprising:

- a tool configured to provide one or more expandable elements between a tubing and a surrounding casing located in a wellbore and to expand said expandable elements against the casing so as to cause the tubing to centre within the casing; or
- a tool configured to expand one or more portions of a tubing against a surrounding casing located in a wellbore so as to cause the tubing to centre within the casing.

According to a third aspect of the invention, there is provided an expandable element configured to be provided between a tubing and a surrounding casing located in a wellbore, the expandable element being operable to expand against the casing so as to cause the tubing to centre within the casing.

BRIEF DESCRIPTION OF THE DRAWINGS

Specific embodiments of the present invention will now be described with reference to the accompanying drawings, in which.

DETAILED DESCRIPTION OF CERTAIN EMBODIMENTS

Figure 1:
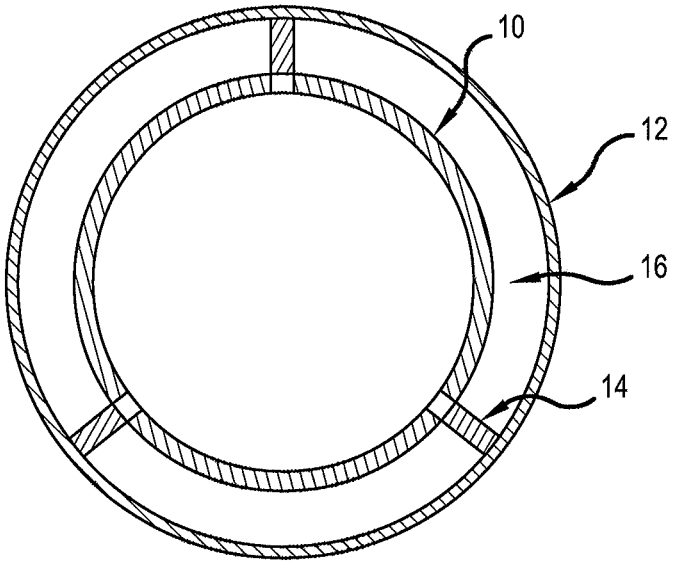
FIG. 1 shows a transverse cross-sectional view of a tubing that has been centralised within a surrounding casing in accordance with a first embodiment of the invention.
Figure 2:
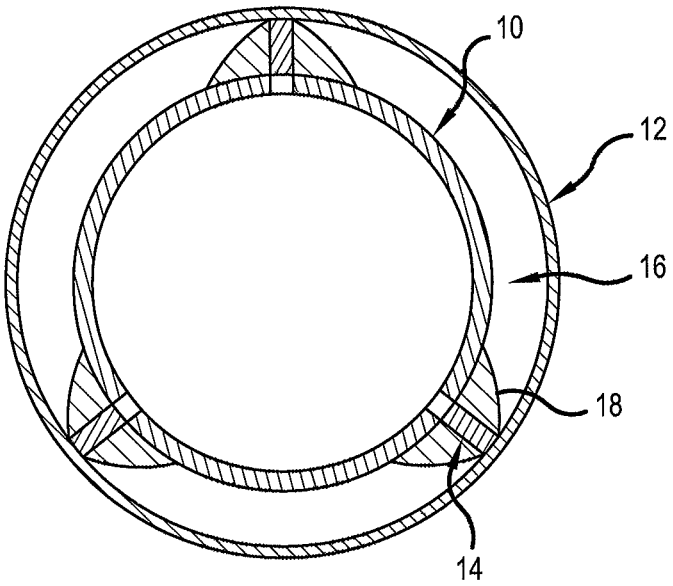
FIG. 2 shows a transverse cross-sectional view of a tubing that has been centralised within a surrounding casing in accordance with a second embodiment of the invention.
Figure 3:
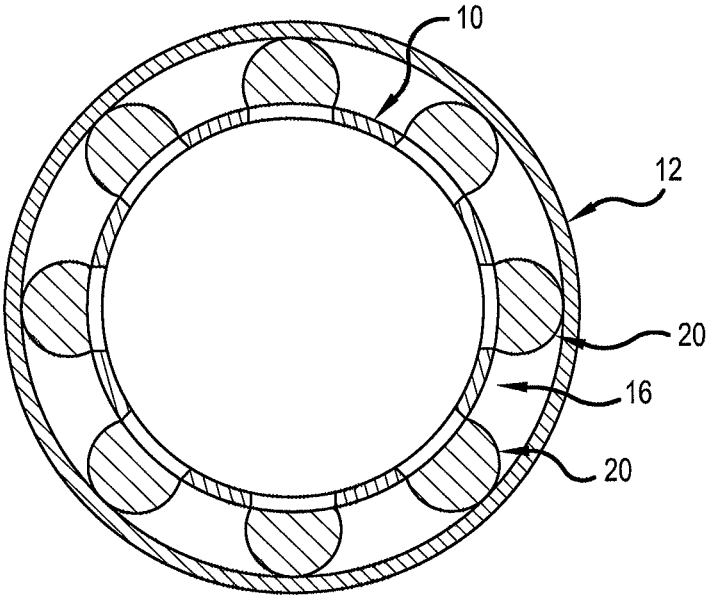
FIG. 3 shows a transverse cross-sectional view of a tubing that has been centralised within a surrounding casing in accordance with a third embodiment of the invention.

FIGS. 1 to 3 illustrate various methods for centralising a tubing in a wellbore in accordance with embodiments of the present invention.

More particularly, FIG. 1 shows production tubing 10 which has been centralised within a surrounding casing 12 by three radially equally spaced expandable support elements 14. This embodiment is an example of a retro-fit operation in that the expandable support elements 14 are provided in an annulus 16 between the tubing 10 and casing 12 after they have both been installed down-hole. Accordingly, this method of centralising the tubing can be used in existing wells without the need for recompletion.

In accordance with the first embodiment, radial holes are cut in the tubing 10 and the expandable support elements 14 are inserted into the annulus 16 and expanded against the casing 12 to cause the tubing 10 to centralise. In this case, the expandable support elements 14 are configured as mechanical devices that can be operated via wireline.

Once the tubing 10 is centred, the same holes (or additional holes) may be utilised to flush and clean-out the annulus 16 before a sealant (e.g. cement) is pumped into the annulus 16 to form a plug therein. It will be noted that in this embodiment, the expandable support elements 14 are left in place and the plug is formed around them.

FIG. 2 shows a second embodiment in which the production tubing 10 is provided with three expandable elements 14 located around the outside of the tubing 10 and retained by an intermediate tubular 18, prior to insertion of the production tubing 10 in the wellbore. The expandable elements 14 in this embodiment are hydraulic pistons which are initially in a collapsed configuration for ease of installation of the production tubing 10 in the casing 12.

When it is desired to centralise the tubing 10 (e.g. before a plug and abandonment procedure), the expandable elements 14 will be activated using wireline so as to cause the intermediate tubular 18 to be locally expanded against the casing 12.

Once the tubing 10 is centred, holes may be formed in the production tubing 10 and the intermediate tubular 18 so that a sealant can be pumped into the annulus 16 to form a fluid-tight plug across the entire width of the annulus 16.

FIG. 3 shows a third embodiment in which eight radial portions 20 of the tubing 10 are expanded against the surrounding casing 12 in the wellbore so as to cause the tubing 10 to centre within the casing 12. In this embodiment an explosive technique is employed to locally deform the tubing 10 in eight equally spaced radial directions whilst ensuring that the integrity of both the tubing 10 and casing 12 is maintained. The spacing between the expanded portions 20 allows fluids to flow through the annulus 16. Although the explosion will be generated by a wireline tool, once the tubing 10 is suitably expanded the tool will be extracted such that no additional equipment is left down-hole in this embodiment.

As above, once the tubing 10 is centred, a cleaning procedure may be undertaken (both inside the tubing 10 and outside the tubing 10) and holes formed in the production tubing 10 so that a sealant can be pumped into the annulus 16 to form a fluid-tight plug across a preferred interval.

It will be understood that, in each of the above embodiments, the axial length of the plug may be significantly larger than the axial extent of the expandable elements 14 and the locally expanded portions of the intermediate tubing 18 and production tubing 10 so as to ensure that there are no potential fluid flow paths through the plug.

It is also envisaged that the steps described in relation to FIGS. 1 to 3 may be repeated at intervals along the tubing 10 and any combination of the methods described may be employed in a single well.

It will be appreciated by persons skilled in the art that various modifications may be made to the above-described embodiments without departing from the scope of the present invention, as defined by the claims. It will also be appreciated that features described in relation to one embodiment may be mixed and matched with features of another embodiment.

The invention claimed is:

1. A method of centralising tubing in a wellbore comprising:

providing one or more expandable elements between a tubing and a surrounding casing located in a wellbore and expanding said expandable elements against the casing so as to cause the tubing to centre within the casing;

said method further comprising:

forming one or more holes in the tubing for access to an annulus between the tubing and the casing;

injecting a sealant material through the one or more holes in the tubing, into the annulus between the tubing and the casing; and forming a fluid-tight seal between the tubing and the casing, wherein the expandable elements are provided between the tubing and an intermediate tubular such that, on activation, the intermediate tubular is expanded outwardly against the casing.

2. The method according to claim 1 when carried out on tubing that has been pre-installed in the wellbore.

3. The method according to claim 1, wherein the holes are further provided for one or more of the following reasons:

i) placing of the expandable elements between the tubing and the casing; and ii) performing a clean-out operation in the annulus.

4. The method according to claim 1, wherein the step of forming one or more holes comprises a radial depth control to ensure that the holes are only provided in the tubing and do not extend into the casing if the tubing is lying on or near to the casing.

5. The method according to claim 1, wherein the seal forms a permanent barrier for well abandonment.

6. The method according to claim 1, wherein the expandable elements are activated mechanically, electrically, magnetically, chemically, hydraulically, pneumatically or explosively, or wherein the intermediate tubular is expanded mechanically, electrically, magnetically, chemically, hydraulically, pneumatically or explosively.

7. The method according to claim 1, wherein the expandable elements comprise a spring, a jack, a piston or an expandable material.

8. The method according to claim 1, wherein the expandable elements are operated substantially simultaneously, or wherein the portions of the tubing are expanded substantially simultaneously.

9. The method according to claim 1, wherein one or more expandable elements are re-set and/or re-used in order to centralise the tubing.

10. The method according to claim 9, wherein one or more supporting elements are provided to maintain the tubing in a desired position after the one or more expandable elements have been expanded.

11. The method according to claim 10, further comprising re-positioning, radially or axially, the expandable element before re-expanding the expandable element to aid centralisation of another part of the tubing.

12. The method according to claim 1, wherein the expandable elements are provided on the tubing or casing prior to installation of the tubing in the casing.

13. The method according to claim 1, wherein the expandable elements are initially provided in a compact configuration and the method comprises activating the expandable elements when it is desired to centralise the tubing within the casing.

14. The method according to claim 1, wherein portions of the intermediate tubular which are expanded are radial portions so as to leave a fluid flow path through the annulus between the tubing and the casing prior to said step of injecting a sealant material through the one or more holes in the tubing.

15. The method according to claim 1, wherein the expandable elements are provided between the tubing and casing and/or activated down-hole using wireline, coiled tubing or pipe.

16. The method according to claim 1, wherein the expandable elements or expanded portions are radially positioned around the tubing, with equal spacing there-between.

17. The method according to claim 1, wherein the method is performed using wireline.

18. An apparatus for centralising tubing in a wellbore, comprising:

a tool configured to provide one or more expandable elements between a tubing and a surrounding casing located in a wellbore and to expand said expandable elements against the casing so as to cause the tubing to centre within the casing;

the apparatus further comprising:

a tool configured to form one or more holes in the tubing for access to an annulus between the tubing and the casing; and a tool configured to inject a sealant material through the one or more holes in the tubing, into the annulus between the tubing and the casing and forming a fluid-tight seal between the tubing and the casing, wherein the expandable elements are provided between the tubing and an intermediate tubular such that, on activation, the intermediate tubular is expanded outwardly against the casing.

* * * * *